United States Patent [19]

Eppensteiner et al.

[11] 4,081,336

[45] Mar. 28, 1978

[54] ALKALINE BRIGHT ZINC PLATING AND ADDITIVE THEREFOR

[75] Inventors: Frederick W. Eppensteiner, Southfield; Carl Steinecker, Westland, both of Mich.

[73] Assignee: The Richardson Company, Des Plaines, Ill.

[21] Appl. No.: 785,514

[22] Filed: Apr. 7, 1977

[51] Int. Cl.[2] ..... C25D 3/24; C25D 3/26

[52] U.S. Cl. ..... 204/55 Y; 204/55 R; 204/DIG. 2; 260/29.2 EP

[58] Field of Search ..... 204/55 R, 55 Y, DIG. 2, 204/114; 252/182; 260/29.2 EP

[56] References Cited

U.S. PATENT DOCUMENTS

| | | | |
|---|---|---|---|
| 3,655,534 | 4/1972 | Kampe | 204/55 R |
| 3,915,815 | 10/1975 | Koch | 204/55 Y |
| 3,957,595 | 5/1976 | DuBrow et al. | 204/55 R |
| 3,972,789 | 8/1976 | Eppensteiner et al. | 204/55 Y |
| 3,974,045 | 8/1976 | Takahashi et al. | 204/55 R |
| 3,988,219 | 10/1976 | Rosenberg | 204/55 R |

*Primary Examiner*—G. L. Kaplan
*Attorney, Agent, or Firm*—Alan M. Abrams

[57] ABSTRACT

An alkaline, electroplating bath for bright zinc plating comprising a heterocyclic nitrogen-containing compound such as, for example, nicotinic acid, which has been alkylated with a condensate of a difunctional halohydrin such as, for example, epichlorohydrin, and a hydroxy aryl compound such as, for example, vanillin, in admixture with certain polyethylenepolyamines or quaternary salts thereof, which bath is capable of producing bright, fine grained zinc deposits over a broad current density range both in the presence and absence of cyanides.

38 Claims, No Drawings

ALKALINE BRIGHT ZINC PLATING AND ADDITIVE THEREFOR

BACKGROUND AND DESCRIPTION OF THE INVENTION

This invention generally relates to bright zinc electroplating and, more particular, to electroplating baths for zinc plating which includes a nitrogen-containing heterocyclic compound which has been alkylated with a condensate of a difunctional halohydrin and a hydroxy aryl compound in admixture with certain polyethylenepolyamines or quaterary salts thereof, which produce bright, zinc electrodeposits and which, moreover, permit the plating to be conducted with various concentrations of cyanide salts or even desirably in the total absence of such salts.

Conventionally, zinc electroplating has been conducted in a plating bath employing alkali metal cyanide salts such as sodium cyanide as an additive or complexing agent to achieve the desired plating operation and particularly to produce bright, smooth grained zinc deposits.

Quite often, the brightness and/or grain of the electrodeposit is not entirely suitable for many plating applications and, accordingly, various additives such as brighteners or grain refiners have been required in the bath in order to enhance the plating. Such additives have not, however, always been effective in their intended use, and typically they also require high levels of cyanides in order to achieve the desired plating. Moreover, because of the toxicity of cyanides and, more recently, because of the environmental considerations adversely affecting the economic employment of these cyanides, other plating methods have been sought which operate effectively either at a low cyanide level or advantageously in the total absence of cyanide salts.

Heretofore, a wide variety of procedures and additives have been proposed for use in zinc plating for the purpose of eliminating the need for cyanides or at least lessening the concentration thereof required. Many of these additives employ an alkaline plating bath system utilizing an alkali metal or sodium zincate combined with various additives such as polyamines to achieve the desired bright zinc deposit and a smooth or fine grained, mirror-like surface.

While certain of these alkaline systems do avoid the use of cyanides or at least high bath concentrations of cyanide, they generally have not been overly successful, and the zinc electrodeposits typically produced have been characterized by a number of deficiencies such as a dull or granular finish which render them of less than acceptable commercial value. Such systems, moreover, typically lack the desired capability of producing a suitable smooth, mirror-like deposit over a broad current density range and generally are especially ineffective at the lower current density ranges which conventionally occur in many commercially plating operations.

It has now been discovered that highly satisfactory alkaline, zinc electroplating can be achieved through the use of a nitrogen-containing heterocyclic compound (for example, nicotinic acid) which has been alkylated with a condensate of a difunctional halohydrin and a hydroxy aryl compound (for example, vanillin) in admixture with certain polyethylenepolyamines, particularly those formed by reacting ammonia with ethylene dichloride, or quaternary salts thereof. The conjoint use of these additives results in the production of fine grained, bright zinc deposits over a broad curent density range both in the presence and absence of cyanide salts.

It is, therefore, a general object of this invention to provide an alkaline, zinc electroplating bath which achieves bright zinc deposits either with various concentrations of cyanide salts or in the total absence of such salts.

Another object of the present invention is to provide such a bath which employs a nitrogen-containing heterocyclic compound, preferably an aromatic heterocyclic nitrogen-containing compound such as nicotinic acid, which has been alkylted with a condensate of a difunctional halohydrin such as epichlorohydrin and a hydroxy aryl compound such as vanillin in admixture with a polyethylenepolyamine such as, for example, one prepared by reacting ammonia with ethylene dichloride, or a quaternary salt thereof.

A further object of the present invention is to employ such alkylated reaction product and polyethylenepolyamine with other conventional plating additives such as brightening agents or grain refiners to achieve bright, mirror-like deposits over a broad current density range.

Still another object of the present invention is to provide a method of zinc electroplating employing such improved bath which is capable of effectively operating in a commercially desirable manner both with and without cyanide salts.

These and other objects of the present invention will be apparent from the following further detailed description thereof.

In accordance with an important aspect of the present invention, the electroplating of zinc is conducted in a bath containing a suitable source of zinc ion to which the alkylated nitrogen-containing heterocyclic compound and polyethylenepolyamine. or quaternary salt thereof, are added in conjunction with other advantageous plating additives including, in particular, certain organosilicone wetting agents. The alkylated nitrogen-containing heterocyclic compounds are produced by reacting the heterocyclic compound with the condensation reaction product of a difunctional halohydrin and a hydroxy aryl compound. Correspondingly, the polyethylenepolyamine is prepared by reacting ammonia and ethylene dichloride in an aqueous alkaline solution. Preferably, the polyethylenepolyamine is then quaternized to form a polyquaternary ammonium salt thereof in accordance with known procedures.

The nitrogen-containing heterocyclic compounds contemplated by the present invention are those which can be alkylated with the difunctional halohydrin-hydroxy aryl condensate and, preferably, include the aromatic nitrogen-containing heterocyclic wherein the aromatic nitrogen becomes quaternized by the alkylation thereof with the difunctional halohydrin-hydroxy aryl condensate. As such, the substituted pyridine and quinoline compounds are particularly preferred compounds for use in the practice of this invention.

Examples of substituted pyridine compounds which can be advantageously employed include the substituted pyridine compounds which have the following general formula:

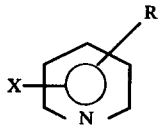

wherein R is a radical selected from the the group consisting of —$NH_2$, —$COOR_1$ wherein $R_1$ is H or lower alkyl of from 1 to 5 carbon atoms, and

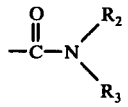

wherein $R_2$ and $R_3$ are alike or different and selected from the group H or lower alkyl of from 1 to 5 carbon atoms; wherein R is in one of the 3 or 4 ring positions and where X is a radical which does not interfere with the alkylation reaction and includes, for example, lower alkyl of from 1 to 5 carbon atoms, halo such as chloro or bromo; lower alkoxy of from 1 to about 5 carbon atoms and —$SO_3Y$ wherein Y is a water soluble cation such as H, Na, K or $NH_4$. Of the foregoing, the pyridines substituted in the 3 ring position are preferred and especially when substituted with carboxy to form such compounds as nicotinic acid for niacin, that is, 3-carboxypyridine. Other compounds having the above formula which may also be employed include, for example, such compounds as 3-carbamoyl-pyridine (nicotinamide); 4-carbamoyl-pyridine; 3-amino-pyridine; 4-amino-pyridine; 3-acylhydrazino-pyridine; 4-acylhydrazinopyridine or 3-amino-5-methoxy-pyridine.

Examples of quinoline substituted compounds which can be advantageously employed in the practice of the present invention include the substituted quinoline compounds which have the following general formula:

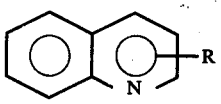

wherein R is a radical as defined above.

The difunctional halohydrins which may be interreacted with the hydroxy aryl compounds include the epihalohydrins such as epichlorohydrin, epibromohydrin or epiiodohydrin with epichlorohydrin being particularly preferred in most instances as well as the glycerol dihalohydrins such as the 1,3-dihalo-2-propanols including, for example 1,3-dibromo-2-propanol, 1,3-diiodo-2-propanol or 1,3-dichloro-2-propanol with the 1,3-dichloro-2-propanol being preferred in most instances. Other halo epoxides or glycerol halohydrins which react in a similar fashion or which form a reaction moiety similar to the epihalohydrin under condensation conditions may also be employed although generally with less desirable results. Such halo epoxides may include the difunctional epoxy alkanes or di-epoxides such as bis-(2,3 epoxypropane) propylene glycol.

The hydroxy aryl compounds contemplated are those which may be interreacted with the difunctional halohydrin and generally may be represented by the following formula:

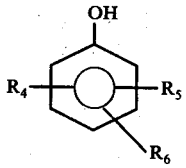

wherein $R_4$, $R_5$ and $R_6$ are alike or different and do not interfere with the reaction between the hydroxy group and the primary carbon atom in the difunctional halohydrin and are radicals selected from the group H; —CHO; —$SO_3Y$ wherein Y is a water soluble cation such as H, Na, K, or $NH_4$; lower alkyl of from 1 to 5 carbon atoms; lower alkoxy of from 1 to 5 carbon atoms; and, halo such as chloro or bromo. Of the foregoing, the hydroxy arylaldehydes are preferred such as, for example, p-hydroxy benzaldehyde, o-hydroxy benzaldehyde, vanillin (p-hydroxy-m-methoxybenzaldehyde), and p-hydroxy-m-ethoxybenzaldehyde with vanillin being particularly preferred for use in most alkaline zinc plating applications.

In preparing the condensate of the difunctional halohydrin and hydroxy aryl compound, the conditions and procedures conventionally employed in condensation reactions between epihalohydrins and hydroxy aryl compounds may, in most instances, be suitably employed. In general, the difunctional halohydrin and hydroxy aryl compound should be condensed in approximately equal molar amounts with a slight excess of the halohydrin being preferred in order to make up for any amounts lost due to evaporization during the reaction. Typically, the reaction is carried out by adding approximately 1.1 mols of the halohydrin to approximately 1 mol of the hydroxy aryl compound with stirring in the presence of a suitable catalyst such as, for example, sodium hydroxide, heating the mixture to approximately 200° F. and allowing the reaction to proceed to completion. The reaction temperature employed may be varied depending upon the particular reactants utilized, but usually ranges from about 160° F. with the temperature of the mixture maintained at a sufficient level so as to provide reflux conditions for a period of time sufficient to complete the reaction. For example, when epichlorohydrin and vanillin are used, a reflux temperature of 240° to 260° F. is maintained for a reaction period of from about 0.5 to 2.0 hours.

A polar solvent such as water or alcohol together with the heterocyclic compound can then be added to the condensate mixture with stirring. In instances wherein the heterocyclic is acidic in nature, sufficient caustic can be added, usually at a reduced temperature of approximately 100° to 150° F. to maintain a slightly alkaline condition for the alkylation reaction. The mixture is then heated to approximately 200° F. or above with continuous mixing for approximately 1 hour. In instances wherein an aromatic aldehyde is used, the reaction product can then be suitably solubilized by the addition of sodium bisulfite while maintaining the temperature of the mixture at between 120° and 140° F.

Upon completion of the quaternization reaction, the product may, if desired, be separated from the reaction mixture using conventional separation or purification techniques such as cyrstallization and/or filtration to recover the desired product. Conveniently, however, and particularly when employing an aqueous reaction medium, the quaterization product need not be separated from the reaction mixture and the final reaction mixture containing the quaternized heterocyclic compound may be directly employed as an additive to the zinc plating bath.

The reaction product obtained by the alkylation of the heterocyclic compound with the condensate of the difunctional halohydrin and hydroxy aryl compound may generally be characterized as a water soluble monomeric salt. While no precise reaction mechanism is being relied upon, it is believed that to some extent, at least, in instances wherein the heterocyclic compound includes an aromatic nitrogen and the condensate is the reaction product of an epihalohydrin and a hydroxy arylaldehyde, alkylation or quaternization of the aromatic nitrogen will occur. For example, in the alkylation of nicotinic acid with a condensate product of epichlorohydrin and vanillin, it is believed that the reaction product will include monomeric compounds which can generally be characterized by the following structural formula:

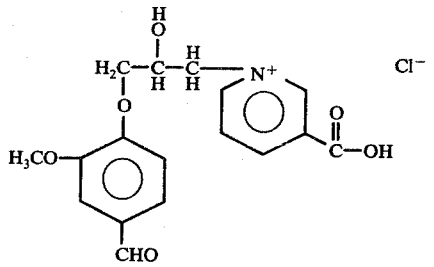

As indicated, the aforementioned quaternized heterocyclic compound is, in accordance with the present invention, used in admixture with certain polyethylenepolyamines or quaternary salts thereof. In this regard, the polyethylenepolyamines contemplated by the present invention are those which are prepared by reacting ammonia with ethylene dichloride. Typically, the ratio of ethylene dichloride to ammonia will usually vary friom 6:1 to 2:1 and preferably 4:1. Typically, the polyethylenepolyamine is formed from the reaction of ammonia and ethylene dichloride under conditions of elevated temperatures and pressures. A suitable procedure which can be employed involves the addition of ethylene dichlorodie into a pressurized system to which anhydrous ammonia is continuously injected at a temperature in the range of from approximately 210° F. to approximately 300° F. and at pressures of 25–75 psi. The pressure in the reaction vessel will increase as the reaction proceeds. As noted, the ratio of ethylene dichloride to anhydrous ammonia will generally be between 6:1 to 2:1 depending upon the other reaction conditions and the molecular weight of the amine that is desired.

Preferably, the polyethylenepolyamine is then quaternized in a known manner such as, for example, by the reaction thereof with methyl chloride. Typically, a concentration ration of polyethylenepolyamine to methyl chloride of from 4:1 to 1:1 can be employed with the preferred ratio being 2:1. This reaction is performed in an aqueous alkaline media and, for this purpose, any alkaline solution may be used, however, sodium hydroxide solution is preferred. The concentration may vary within a wide range but is generally 20–60 percent based on the amine content. A small amount of catalyst can be used to initiate the reaction and, for this purpose, any catalyst which is well known in the art may be used, including organic and inorganic types. The reaction is typically conducted at en elevated temperature of between 175° F. and 300° F. The polyquaternary ammonium salt which is formed is thereby used in this liquid state. Suitable polyethylenepolyamines and quaternary salts thereof which can be employed in the present invention include those which are described in U.S. Pat. No. 3,957,595, the disclosure of which is incorporated herein by reference.

The electroplating bath of this invention may be prepared and operated in accordance with the general procedures conventionally employed for alkaline, bright zinc plating. Typically, the bath is prepared as an aqueous solution and rendered alkaline by the addition of a suitable alkaline material such as alkali metal hydroxide, for example sodium or potassium hydroxide. The quaternized heterocyclic compound and polyethylenepolyamine can then be added, usually in the form of an aqueous concentrate. The quantity of alkaline material added should be capable of dissolving the zinc compound employed as the source of zinc ion in the bath and generally should be in excess of that required to create in certain baths a desired alkali metal zincate such as sodium zincate as well as to maintain the pH of the solution alkaline and generally 12 and above which corresponds to a sodium hydroxide concentration of from about 50 to 150 grams per liter.

The source of the zinc ion in the bath can be varied and generally any kind of zinc compounds conventionally employed in alkaline bright zinc baths may be utilized. Typically, such compounds include water soluble or aqueous alkaline soluble, zinc salts or oxides such as zinc sulfate, zinc acetate, or zinc oxide with the zinc sulfate generally being preferred for cyanide-free baths and zinc oxide for cyanide containing baths. The amount of zinc in the bath can be varied depending upon the desired results and operating conditions but is usually maintained within the range of from about 1 to about 55 grams per liter with a more limited range of about 3 to 35 grams per liter being more typical.

The amount of quaternized heterocyclic compound utilized in the bath of this invention will generally be a function of the particular heterocyclic compound, epihalohydrin and hydroxy arylaldehyde used in the formation thereof as well as a function of whether the bath is operated with or free of cyanides. Typically, however, when employing a vanillin-epichlorohydrin condensate to quaternize a heterocyclic compound such as nicotinic acid, the quantity of this reaction product in the bath will range from about 0.01 to about 2.0 grams per liter with a more limited range of from about 0.25 to about 0.50 grams per liter being preferred.

The quantity of polyethylenepolyamine utilized in the bath will, in general, be a function of the particular quaternized heterocyclic compounds employed as well as the particular polyethylenepolyamine employed and whether such polyethylenepolyamine has been quaternized. Typically, however, when employing quaternized polyethylenepolyamines formed from a reaction mixture wherein the ratio of ethylene dichloride to ammonia is approximately 4:1 which reaction product is then quaternized with methyl chloride in a reaction mixture wherein the ratio of polyethylenepolyamine to methyl chloride is approximately 2:1, the quantity of such polyethylenepolyamine in the bath should range from about 0.25 to about 5 grams per liter with a more limited range of from about 0.3 to about 0.75 grams per liter being preferred.

When the bath of this invention is operated in the presence of cyanide salts, such salts may include any of the salts or equivalent sources of cyanide ion conventionally used in zinc cyanide plating. Typically, such cyanide salt is an alkali metal cyanide such as sodium or potassium cyanide. The quantity of the cyanide salt present in the bath may range from about 2 to about 200 grams per liter with a more limited and lower range of from about 8 to about 130 grams per liter generally being preferred for most applications.

As indicated, the bath of this invention may be operated either with or without cyanide ions. Typically, when operated with cyanides, the quaternized heterocyclic compound and polyethylenepolyamine cooperatively act as brighteners and, as such, may be utilized as a replacement for, or as a substitute to, the conventional brighteners used in zinc electroplating baths. When operating without, or in the absence of cyanides, the quaternized heterocyclic compound and polyethylenepolyamine cooperate to act as a grain refiner for the electroplate and when combined with brighteners produce fine grained, mirror-bright, zinc electrodeposits.

The plating bath of this invention may contain other additives of the type conventionally employed in alkaline zinc electroplating baths and include such materials as brightening agents such as aldehydes, grain refiners such as polyamines, gelatin, glues, peptone or polyvinyl alcohols.

Another aspect of the present invention involves the discovery that certain organosilicone wetting agents, namely the water soluble polysiloxane-containing block copolymers such as, for example, the poly(dimethylsiloxane)-poly(oxyalkylene) copolymers wherein approximately at least half the molecular weight is due to oxyethylene units and the silicone-glycol block copolymers such as the silicone-polyethylene glycol block copolymers having a molecular weight of up to approximately 5000 and which exhibit water solubility may be advantageously used in conjunction with the alkylated heterocyclic compounds and polyethylenepolyamines in the alkaline zinc plating baths of the present invention. In this regard, it has been found that these organosilicone wetting agents function in these baths to sidnificantly reduce and/or totally eliminate pitting, promote brightness, and increase both adhesion and throwing power. Suitable organosilicone wetting agents which are commercialy available include Dow Corning 414 and 470A (Dow Corning Company) as well as L7600, L7001, L7602 and L7604 (Union Carbide). Typical concentrations of these organosilicone wetting agents in the bath will range from approximately 0.01 grams to 1.0 grams per liter with the more limited range of 0.1 to 0.5 grams per liter being preferred.

Other brighteners which may be used in conjunction with the quaternized heterocyclic compound and polyethylenepolyamines of the present invention include those conventionally employed in zinc plating such as the organic aldehydes which contain a carbonyl group of aldehyde functionality and generally may be represented by the formula:

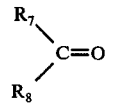

wherein $R_7$ and $R_8$ are alike or different and selected from the group consisting of hydrogen, alkyl of from generally 1 to about 10 carbon atoms, aryl and heterocyclic oxygen and sulfur containing radicals and include, for example, m-hydroxy benzaldehyde, p-hydroxy benzaldehyde, piperonal, o-hydroxy benzaldehyde, furfural, glyceraldehyde, anisaldehyde, vanillin and thiophene-2-aldehyde.

The aldehyde brighteners used in combination with the quaternized heterocyclic compound and polyethylenepolyamine of the present invention usually will be present in the bath within the ranges conventionally utilized for alkaline zinc plating baths. Typically, this will range from about 0.05 to about 5 grams per liter and preferably is from about 0.1 to 0.5 grams per liter.

Polyvinyl alcohol may also be suitably used in the bath of this invention especially to enhance the obtainment of a mirror-like finish for the electrodeposits. When so employed, these polyvinyl alcohols should be utilized in the bath within a range of from about 0.001 to about 0.5 grams per liter.

The electroplating of zinc conducted in accordance with the process of this invention is effected in conventional fashion basically by passing a direct current from a zinc anode through the aqueous alkaline bath of this invention, containing essentially the quaternized heterocyclic and polyethylenepolyamine compounds, zinc ions, cyanide ions if used and other additives such as brighteners and grain refiners, to the desired cathode article which is to be electroplated with the zinc. This process may be conducted at a temperature of from about 10° to about 100° C. or more, typically about 15° to about 45° C. The current densities employed may range from above about 0 to about 200 amperes per square foot with a more limited range of from about 1.0 to about 120 amperes per square foot being satisfactory for most plating operations.

The following examples are offered to illustrate the plating bath and electroplating methods of this invention.

EXAMPLE 1

Condensation

Into a 1 liter, three neck flask equipped with a mechanical stirrer, dropping funnel, thermometer, condenser and heating mantle, were placed 152 grams (1 mol) of vanillin which was heated to a temperature of approximately 185° F wherein the vanillin was in a molten condition. Into the molten vanillin, 4 grams of liquid caustic soda (50 weight percent) were added and the mixture then stirred until uniform. This moisture was then further continuously stirred while being heated to a temperature of between 240°-250° F. during which time 100 grams (1.1 mols) of epichlorohydrin were added dropwise over a one hour period. The mixture was then maintained at a temperature of approximately 260° F. until the reaction was completed.

Alkylation

Into the above flask, 200 ml. of water, 123 g. (1 mol) of nicotinic acid, and 80 grams (1 mol) of aqueous caustic soda (50 weight percent) were added. This mixture was then stirred and heated for 1 hour at the reflux temperature (about 220° F.) at which point the reaction was complete.

This reaction product while in solution form would tend to precipitate out of solution upon dilution. In order to assure the solubilization of the alkylated reaction product upon dilution, the reaction mixture was then cooled down to about 140° F. and to this mixture 110 grams (0.58 mols) of sodium metabisulfite were added. This mixture was stirred for approximately ½ hour at which point the reaction was completed and the reaction product could then be added directly to a zinc plating bath without precipitating out of solution.

EXAMPLE II

A series of zinc electroplatings were conducted in various aqueous alkaline cyanide and non-cyanide electroplating baths to zinc plate steel Hull cell test panels. The plating was carried out in a standard Hull cell (267 ml.) with the Hull cell panel in each test connected as the cathode and with a 99.99 percent high purity zinc metal bar used as the anode. The plating was conducted at a total operating current of 1.0 ampere which represents a current density range on the test panel varying from a high range of from about 40 to 100 amperes per square foot (a.s.f.) to a low range of from 0.1 to about 0.5 (a.s.f.). The plating time was 10 minutes and the bath was operated about 75° F. In each test a bath was prepared with the various components admixed and then employed to plate the test samples. The components of the various plating baths are summarized in Table I with the results summarized in Table II.

TABLE I

| Test Run | Component A | B | C | D | E |
|---|---|---|---|---|---|
| 1 | 7.5 | — | 100 | — | 2.5 |
| 2 | 7.5 | — | 100 | 0.25 | — |
| 3 | 7.5 | — | 100 | 0.25 | 2.5 |
| 4 | 7.5 | — | 100 | 0.25 | 6.0 |
| 5 | 7.5 | 15.0 | 75.0 | 0.4 | — |
| 6 | 7.5 | 15.0 | 75.0 | 0.4 | 2.5 |

BATH COMPONENTS

A - Zinc metal (grams/liter)
B - Sodium cyanide (grams/liter)
C - Sodium hydroxide (grams/liter)
D - Alkylated heterocyclic reaction product of Example 1 (milliliters of 1 molar solution added)
E - Quaternary ammonium salt of polyethylenepolyamine as prepared by procedures of U.S. Pat. 3,957,595 (milliliters of 10 weight percent solution added)

TABLE II

| Test Run | Plating Results |
|---|---|
| 1 | Light grey to dull finish over entire panel |
| 2 | Amorphous and powdery finish from high current density edge (HCD) to 30 a.s.f., brilliant but striated finish from 30 a.s.f. to 10 a.s.f., semi-bright finish from 10 a.s.f. to low current density edge (L.C.D.) |
| 3 | Grain refined with bright mirror-like finish from L.C.D. to 30 a.s.f. |
| 4 | Grain refined with bright mirror-like finish from L.C.D. to H.C.D. |
| 5 | Dull finish from H.C.D. to 25 a.s.f., striated finish from 25 a.s.f. to L.C.D. |
| 6 | Semi-bright finish from H.C.D. to 40 a.s.f. and grain refined, bright finish from 40 a.s.f. to L.C.D. |

The plating results summarized in Table II illustrate that the alkylated heterocyclic compounds and polyethylenepolyamines cooperatively function in accordance with the procedures of this invention to improve the plating ability of the bath and can be successfully utilized in both cyanide and cyanide-free alkaline zinc electroplating baths.

We claim:

1. A bright zinc, electroplating bath comprising an aqueous alkaline solution containing a source of zinc ions and a nitrogen-containing heterocyclic compound which has been alkylated with a condensate of a difunctional halohydrin and a hydroxy aryl compound in admixture with a polyethylenepolyamine formed by the reaction of ammonia and ethylene dichlorode or a quaternary salt thereof.

2. The bath of claim 1 wherein the alkylated nitrogen-containing heterocyclic compound is present in an amount of from 0.01 to 2.0 grams per liter.

3. The bath of claim 1 wherein the alkylated nitrogen-containing heterocyclic compound is present in an amount of from 0.25 to 0.50 grams per liter.

4. The bath of claim 1 wherein the polyethylenepolyamine or quaternary salt thereof is present in an amount of from 0.25 to 5.0 grams per liter.

5. The bath of claim 1 wherein the polyethylenepolyamine or quaternary salt thereof is present in an amount of from 0.3 to 0.75 grams per liter.

6. The bath of claim 1 wherein the heterocyclic compound contains an aromatic nitrogen.

7. The bath of claim 6 wherein the heterocyclic compound is a substituted pyridine or substituted quinoline compound.

8. The bath of claim 6 wherein the heterocyclic compound is nicotinic acid.

9. The bath of claim 1 wherein the difunctional halohydrin is an epihalohydrin.

10. The bath of claim 9 wherein the epihalohydrin is epichlorohydrin.

11. The bath of claim 1 wherein the difunctional halohydrin is a glycerol dihalohydrin.

12. The bath of claim 11 wherein the glycerol dihalohydrin is 1,3-dichloro-2-propanol.

13. The bath of claim 1 wherein the hydroxy aryl compound has the following structural formula:

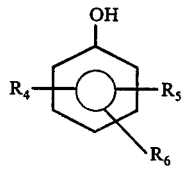

wherein $R_4$, $R_5$ and $R_6$ are selected from the group H; —CHO; —$So_3Y$ wherein Y is a water soluble cation; lower alkyl of from 1 to 5 carbon atoms; lower alkoxy of from 1 to 5 carbon atoms; and, halo.

14. The bath of claim 13 wherein the hydroxy aryl compound is a hydroxy aryladehyde.

15. The bath of claim 14 wherein the hydroxy arylalehyde is vanillin.

16. The bath of claim 1 wherein the ratio of ethylene dichloride to ammonia ranges from 6:1 to 2:1.

17. The bath of claim 16 wherein the ratio of ethylene dichloride to ammonia is approximately 4:1.

18. The bath of claim 1 wherein the polyethylenepolyamine quaternary salt is the reaction product of methyl chloride and polyethylenepolyamine which is formed by the reaction of ammonia and ethylene dichloride, with the ratio of ethylene dichloride to ammonia ranging from 6:1 to 2:1.

19. The bath of claim 1 wherein the bath contains a source of cyanide ions.

20. The bath of claim 1 wherein the bath is free of cyanide ions.

21. The bath of claim 1 wherein the bath contains a brightener in addition to said alkylated nitrogen-containing heterocyclic compound and said polyethylenepolyamine or quaternary salt thereof.

22. The bath of claim 21 wherein said brightener is an organic aldehyde.

23. The bath of claim 1 wherein said bath contains a grain refiner in addition to said alkylated nitrogen-containing heterocyclic compound and said polyethylenepolyamine or quaternary salt thereof.

24. The bath of claim 1 wherein the source of zinc ions is an aqueous soluble zinc compound.

25. The bath of claim 24 wherein the source of zinc ions is zinc sulfate or zinc oxide.

26. The bath of claim 1 wherein the bath contains a polyvinyl alcohol.

27. The bath of claim 1 wherein the nitrogen-containing heterocyclic compound is a substituted pyridine or quinoline compound, said difunctional halohydrin is an epihalohydrin, and said hydroxy aryl compound is a hydroxy arylaldehyde.

28. The bath of claim 27 wherein said aromatic nitrogen-containing heterocyclic compound is nicotinic acid or nicotinamide.

29. The bath of claim 27 wherein said epihalohydrin is epichlorohydrin.

30. The bath of claim 27 wherein said hydroxy arylaldehyde is vanillin.

31. A process for electroplating for zinc which comprises effecting the electroplating within the bath of claim 1.

32. The process of claim 31 wherein the plating is effected free of any cyanide ions.

33. The process of claim 31 wherein the plating is effected in the presence of cyanide ions.

34. The process of claim 31 wherein the plating is conducted at a temperature of from about 10° to about 100° C. and at a current density of up to about 200 amperes per square foot.

35. An aqueous concentrate for preparing the bath of claim 1 which concentrate includes a nitrogen-containing heterocyclic compound which has been alkylated with a condensate of a difunctional halohydrin and hydroxy aryl compound is admixture with a composition selected from the group polyethylenepolyamine and quaternary salts thereof wherein the polyethylenepolyamine has been formed by the reaction of ammonia with ethylene dichloride, the ratio of ethylene dichloride to ammonia ranging from 6:1 to 2:1.

36. The aqueous concentrate of claim 35 wherein the nitrogen-containing heterocyclic compound includes an aromatic nitrogen.

37. The aqueous concentrate of claim 35 wherein the difunctional halohydrin is epichlorohydrin.

38. The aqueous concentrate of claim 35 wherein the hydroxy aryl compound is a hydroxy arylaldehyde.

* * * * *

UNITED STATES PATENT AND TRADEMARK OFFICE

CERTIFICATE OF CORRECTION

PATENT NO. : 4,081,336

DATED : March 28, 1978

INVENTOR(S) : Frederick W. Eppensteiner and Carl Steinecker

It is certified that error appears in the above-identified patent and that said Letters Patent are hereby corrected as shown below:

Column 5, line 46, "dichlorodie" should read --dichloride--
Column 7, line 49, "sidnificantly" should read --significantly-
Column 7, line 53, "commercialy" should read --commercially--
Column 8, line 58, "moisture" should read --mixture--
Column 12, line 8, "for zinc" should read --of zinc--
Column 12, line 23, "is" should read --in--

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,081,336

DATED : March 28, 1978

INVENTOR(S) : Frederick W. Eppensteiner et al.

It is certified that error appears in the above-identified patent and that said Letters Patent are hereby corrected as shown below:

Page 1, the name of the assignee should read --Richardson Chemical Company--

Signed and Sealed this

*Fourteenth* Day of *August 1979*

[SEAL]

*Attest:*

*Attesting Officer*

LUTRELLE F. PARKER

*Acting Commissioner of Patents and Trademarks*